United States Patent [19]

Curtius et al.

[11] 4,212,646

[45] Jul. 15, 1980

[54] PROCESS FOR THE PRINTING OF MIXED FABRICS OF POLYESTER AND CELLULOSE FIBERS

[75] Inventors: Horst Curtius, Kelkheim; Erich Feess, Hofheim am Taunus; Willy Gronen, Schöllkrippen, all of Fed. Rep. of Germany

[73] Assignee: Hoechst Aktiengesellschaft, Frankfurt, Fed. Rep. of Germany

[21] Appl. No.: 940,483

[22] Filed: Sep. 7, 1978

[30] Foreign Application Priority Data

Sep. 9, 1977 [DE] Fed. Rep. of Germany ..... 2740587

[51] Int. Cl.[2] ..... C09B 27/00; D06P 1/02

[52] U.S. Cl. ..... 8/532; 8/664; 8/666; 8/667; 8/672

[58] Field of Search ..... 8/21 C, 24, 44, 48, 8/49, 50

[56] References Cited

U.S. PATENT DOCUMENTS

| | | | |
|---|---|---|---|
| 189,371 | 4/1877 | Mather | 8/74 |
| 2,514,410 | 7/1950 | Olpin et al. | 8/63 |
| 3,140,914 | 7/1964 | Ward et al. | 8/24 |
| 3,597,144 | 8/1971 | Leddy | 8/74 |
| 3,708,257 | 1/1973 | Lowenfeld et al. | 8/21 C |
| 3,713,767 | 1/1973 | Lowenfeld et al. | 8/21 C |
| 3,787,179 | 1/1974 | Lowenfeld | 8/71 |
| 3,961,887 | 6/1976 | Gronen et al. | 8/71 |
| 4,052,157 | 10/1977 | Fuchs et al. | 8/71 |
| 4,094,637 | 6/1978 | Feess et al. | 8/71 |

FOREIGN PATENT DOCUMENTS

| | | | |
|---|---|---|---|
| 14950 | 11/1880 | Fed. Rep. of Germany . | |
| 7113828 | 4/1972 | Netherlands | 8/71 |
| 525099 | 8/1940 | United Kingdom | 8/71 |

*Primary Examiner*—Ronald W. Griffin

*Attorney, Agent, or Firm*—Curtis, Morris & Safford

[57] ABSTRACT

Process for printing textile mixed fabrics of polyester and cellulose fibers with printing pastes containing coupling components dissolved in an alkaline medium, sodium nitrite, diazotizable primary aromatic amines and optionally disperse dyestuffs, in which process the amines are used as a solution or in the form of an aqueous fine dispersion with a particle size of less than 0.03 mm and are selected in a manner that they are practically non-volatile at the drying temperatures and exhibit minimum basicity with the $pK_a$ being 2.2 or more, developing the water-insoluble azo dyestuffs on the fiber by diazotizing the amines and coupling the diazonium compounds formed with the coupling components following the drying of the printing pastes applied by a treatment of the printed fabrics at room temperature with an aqueous developing bath containing formic acid, and completing the coupling as well as the fixation of azo dyestuffs formed and of optionally employed disperse dyestuffs on the polyester fiber portion without previous intermediate drying, however, optionally after an air passage, either by steaming with high temperature steam or by a fast steaming with saturated steam and subsequent treatment with dry heat and/or high-temperature steam.

9 Claims, No Drawings

PROCESS FOR THE PRINTING OF MIXED FABRICS OF POLYESTER AND CELLULOSE FIBERS

The present invention relates to a process for the printing of mixed fabrics of polyester and cellulose fibers.

In German Patent Specification No. 14 950 (Grässler, 1880) a process has been described in which a coupling component (β-naphthol), a diazotizable primary aromatic amine (xylidine) and sodium nitrite are printed together from a printing paste on cotton in the presence of ammonium salts of strong acids as acid-yielding agents, and this print is developed by steaming, in which process the diazotization of the amine and then the coupling of the diazonium compound formed with the β-naphthol are achieved by the influence of the remaining acid after the escaping of ammonia due to hydrolysis.

In recent times this "all-in" principle has been realized, while using "finished" products without an incorporated acid-yielding agent with alkaline printing pastes, and subsequently developing the azo dyestuff by way of an acid passage as a "two phase" process, by which method coupling components dissolved in an alkaline medium, finely dispersed bases and sodium nitrite are printed together from a printing paste onto a cellulose fiber fabric, and following the drying of the textile goods in the mansarde the developing of the insoluble azo dyestuff is effected by diazotization of the amine and coupling of the diazonium compound thus produced with the coupling component by way of an acid passage, for example by overpadding or slop-padding, spraying or other methods.

In this process use was mostly made of non-volatile organic acids, such as lactic acid, tartaric acid, oxalic acid, glycolic acid or mixtures thereof, and the possibility of using inorganic acids, such as phosphoric acid, volatile inorganic acids, such as hydrochloric acid, and acid salts of inorganic acids, such as sodium hydrogenosulfate, was considered (lit: Feess, E., Textil-Praxis International, 1976, vol. 11, pages 1307 to 1318 and vol.12, pages 1423 to 1427).

In this process, difficulties with regard to the yield and the reproducibility of the azo dyestuff were quite evident, and there was also the risk of fiber damaging in the unprinted portions. Tests have shown that for reasons of the local concentration and pH conditions either the diazotization (not enough acid) or the coupling (too much acid) were incomplete. In this manner it was not possible to reach optimum results; however, when using monochloroacetic acid as developing agent, useful results were actually obtained. Nevertheless, under these conditions a considerable development of nitrous gases from the excess nitrite cannot be avoided.

The use of volatile organic acids proved to be impossible, since unsubstituted monocarboxylic acids having 2 or more carbon atoms show an insufficient degree of dissociation and are therefore not acidic enough; the stronger formic acid, however, was not considered applicable due to its known reducing effect on nitrous acid.

When developing azo dyestuffs in a steamer atmosphere that has been saturated with vapors of acetic acid and their homologues, the formation of nitrous gases is actually reduced and there is no fiber damaging, either, but the dyestuff yield is insufficient due to incomplete diazotization, and the color shades are not reproducible.

It has now been found that mixed fabrics of polyester and cellulose fibers can be printed with water-insoluble azo dyestuffs formed on the fiber, if printing pastes are employed which contain coupling components (C.I.: Azoic Coupling Components) dissolved in an alkaline medium, sodium nitrite and diazotizable primary aromatic amines (C.I.: Azoic Diazo Components), said amines being present as a solution or in the form of an aqueous fine dispersion with a particle size of less than 0.03 mm and being selected according to the invention in a manner that they are practically non-volatile under the drying temperatures and show a minimum basicity with the $pK_a$ being 2.2 or more. The development to yield the azo dyestuff is achieved in accordance with the invention following the drying of the applied printing paste (via the diazotization of the amine and the coupling which takes place almost simultaneously) by a treatment of the printed textile material at room temperature with an aqueous developing bath containing formic acid in an amount corresponding to 10 to 100 g/l of a 85% formic acid. By way of a short passage in a normal or high-temperature steamer, into which the material is introduced without previous intermediate drying, however, optionally after an air passage of up to 10 seconds, the coupling is completed, and a high portion of the azo pigment formed is fixed on the polyester fiber portion. If this process is effected in a single operation in the high-temperature steamer, the high-temperature steam is allowed to act on the material for a period of 3 to 10 minutes at a temperature of from 170° to 190° C., otherwise—in order to complete the formation of the azo dyestuff by coupling—steaming is effected for a period of 3 to 20 seconds at 100° to 130° C., and subsequently part of the azo dyestuff is fixed according to a thermosol process for a period of from 10 to 40 seconds at a temperature of from 190° to 210° C. (dry heat) or in the high-temperature steamer under the standard conditions set forth above. In both subsequent fixing processes the fixation is prepared by a drying process. The latter may be effected, while steaming, during the same operation step in the same apparatus, i.e. it may be incorporated, or it may be intercalated separately, with less expensive drying methods and apparatuses being preferred. There may be mentioned drying rollers or festoon driers for this purpose. Dispersion dyestuffs may optionally be added to the printing pastes. This is particularly interesting in cases where the azo dyestuff itself is not sufficient to produce a covering print of the same color depth and color shade on the polyester fiber portion of the goods. If required, the type and the amount of the disperse dyestuff added are to be chosen according to these criteria.

According to the process of the invention clear and reproducible color shades and color depths are obtained on the cellulose fiber portion of the mixed fabric which correspond to the amounts employed of the dyestuff-forming components. Since a considerable portion of the azo pigment under heat also penetrates by diffusion into the polyester fiber component, the amount of disperse dyestuffs ascertained for a determined color depth may be strongly reduced (often by far more than half the amount).

In the process of the invention there is no damaging of the fiber, nor an undesired development of nitrous gases. Due to the requirement to expose the fabrics treated with acid to high temperatures, the use of non-volatile acids for polyester/cellulose mixed fabrics is not possible. As a matter of fact, if said acids were used, a buffer mixture would be formed at the printed places due to the presence of alkali in the printing paste under normal conditions, the buffer mixture excluding a fiber damaging, but at the unprinted places a carbonization of the cellulose fiber portion would take place in the drying process, however, at the latest during the dyestuff fixation step for the polyester fiber portion. This phenomenon would be useful to obtain certain effects, such as burn-out effects, however, in most cases this process is undesired.

It was an extremely surprising fact which could not have been foreseen that formic acid can be employed excellently for the development of azo dyestuffs from the components printed on the material, with special consideration being given to the dyestuff yield and the reproducibility as the criteria, and that in the process according to the invention the annoying, undesirable nitrous gases, which may even be hazardous to the health of persons exposed to them, were found only to an insignificant degree.

It was necessary to overcome the experts' prejudice resulting from the knowledge that formic acid and nitrous acid destroy each other, thus neutralizing their activity. However, the reaction proceeds evidently at a lower rate and therefore preferably following the diazotization process and especially in the steamer at elevated temperatures, which involves another advantage. The excess amount of formic acid is not only reduced by its volatility, but also by this oxidation to give $CO_2$, which favors the coupling. The remaining nitrous acid is reduced for the most part in the vapor phase to give dinitrogen oxide and nitrogen. An adverse influence on dispersion dyestuffs possibly used on the polyester fiber portion is also controlled thereby, however, the use of disperse dyestuffs containing amino groups should still be avoided.

As thickening agents for the printing inks there are mentioned starch ethers, bean flour ethers, guaranates, alginates and the mixtures thereof.

For the process of the invention there may be used those diazotizable primary aromatic amines (fast color bases) which meet the following requirements:

They are not to show any, or only a very slight volatility under drying conditions, they must be present in the form of a solution or aqueous fine dispersions with a particle size of less than 0.03 mm, and they must show a minimum basicity (expressed by the $pK_a$ value being equal to, or above, 2.2).

According to the invention, the following products are suitable, for example, while maintaining the above-mentioned required standard:

| Azoic Diazo Component | C.I. No. |
|---|---|
| 132 | 37 111 |
| 29 | 37 140 |
| 31 | 37 145 |
| 42 | 37 150 |
| 14 | 37 151 |
| 24 | 37 155 |
| 43 | 37 160 |
| 41 | 37 165 |
| 40 | 37 170 |
| 20 | 37 175 |
| 15 | 37 180 |
| 4 | 37 210 |
| 27 | 37 215 |

-continued

| Azoic Diazo Component | C.I. No. |
|---|---|
| 48 | 37 235 |

In combination with the coupling components a great number of color shades having favorable fastness properties are possible on the cellulose fiber component.

The diazotizable primary aromatic amines have a more or less strongly pronounced basic character, i.e. with acids they can form salt-like addition compounds ("salts"). The higher (more pronounced) the basicity of an amine, the stronger is its tendency to form salts also with weaker acids, without hydrolysis taking place. The forming of these salts is one of the preconditions for the realization of a diazotization and for its complete development.

As the process of the invention operates with formic acid, a minimum basicity is required.

Aromatic amine whose basicity is too low are not appropriate for the process of the invention; they could only be diazotized with strongly dissociated mineral acids in excess concentrations, since otherwise hydrolysis will take place.

The degree of basicity may be expressed by the value $pK_a$. The $pK_a$ value is defined as the negative decimal logarithm of the dissociation constant of the base (the amine) in the molar equilibrium with its own salt of a strong acid. The $pK_a$ value is numerically proportional to the basicity, i.e. a high $pK_a$ value indicates a high basicity.

For the process of the invention, a minimum basicity of the amines with the $pK_a$ being equal to, or above, 2.2 is required.

Literature with regard to the $pK_a$ value:

Handbook of Chemistry and Physics, CRC-Press, Cleveland, Ohio.

Fieser L. F. & Fieser M., Organic Chemistry, 3rd edition 1956, page 597, New York.

Perrin, D. D. Dissociation Constants of Organic Bases in Aqueous Solution, Butterworth, London.

For the development of these prints by diazotization and coupling an acid treatment is generally required.

In this process the acid has several functions: It serves to neutralize the alkali in the printing paste, to adjust the optimum coupling range in the acid medium, to form the salt of the amine to be diazotized, and to free the nitrous acid $HNO_2$ from the sodium nitrite.

If for this purpose there are used non-volatile, strong organic acids, acid salts of an inorganic acid, such as sodium hydrogenosulfate, or even mineral acids, the conditions are favorable for the diazotization, however, unfavorable for the coupling, since the coupling range frequently falls short of the optimum value (too acid). A fiber damaging of the cellulose, especially in the unprinted places, cannot be avoided in the drying, steaming or thermosoling processes. Nitrous gases are formed in detrimental amounts.

When using the volatile weak acetic acid, no fiber damaging is indeed to be expected, however, the conditions for the diazotization are not optimum, which adversely affects the dyestuff yield.

In the case of mixtures of non-volatile strong and volatile weak organic acids the strong acids are first partially neutralized; the dyeing result then depends on which acid, and what amount thereof, remains in the free state at the printed places.

Formic acid as a developing medium, due to its specific properties meets the requirements of the process of the invention:

It is dissociated to a sufficiently high degree, in order to be suitable to react also with amines of a relatively low basicity while forming stable (non-hydrolyzing) salts.

It forms with the sodium formate having been obtained by the neutralization of the alkali of the printing paste an active buffering system which maintains the coupling capacity of the coupling component in the acid range for the period of dyestuff formation, by which measure even fluctuations in the vapor temperature are not detrimental to the constancy of the color shade.

It is volatile, which excludes a fiber damaging of the cellulose at elevated temperatures.

Finally, it contributes to the fact that nitrous gases are formed to a much smaller extent than with other acids.

Formic acid reacts in heat (also in the vapor phase) with excess nitrous acid, in which process the two acids consume each other. Laboratory tests and analyses have shown that in the reaction there are predominantly formed carbon dioxide, di-nitrogen oxide $N_2O$, nitrogen, water vapor as well as a portion of NO. This reaction develops at a later stage or at a lower rate than the diazotization. Besides, in the course of this process a shift of the pH value takes place towards the neutral point, which is advantageous for the coupling.

The following Examples serve to illustrate the invention.

EXAMPLE 1

(1) A coupling component, Azoic Coupling Component 14 with the C.I. No. 37 558, is dissolved in common manner according to the cold vatting method, however, without the usual addition of formaldehyde. For this purpose, 50 g of this coupling component are stirred into a paste with 50 g of denatured ethanol, whereupon 25 g of 32.5% sodium hydroxide solution are added, and the mixture is then diluted with 75 g of water of 40° C. After a short-time stirring, a clear solution is obtained.

200 g.

(2) A diazo component (undiazotized primary amine), Azoic Diazo Component 132 with the C.I. No. 37 111, present in the form of a fine-grained 40% aqueous dispersion, is stirred with water at room temperature:

125 g of said diazo component (40% strength) and 125 g of water of 20° C.

250 g.

(3) 7 Grams of a disperse dyestuff in liquid form of the formula

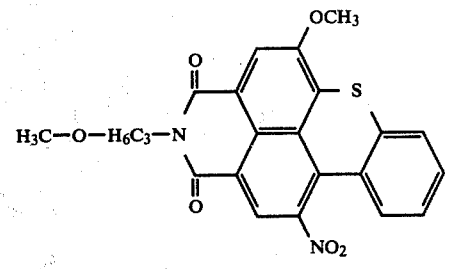

and 10 g of a disperse dyestuff in pulverulent form having the formula

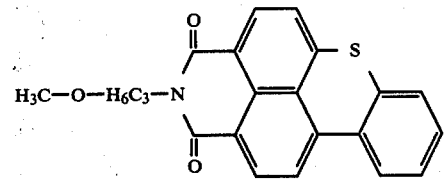

are predispersed together with 63 g of water of 40° C., while stirring.

The solution (1) of the coupling component thus prepared, the suspension of the diazo component (2) and the dispersion of the disperse dyestuffs (3) are stirred one after the other with a stirrer into a stock thickening consisting of 30 g of thiodiglycol, 10 g of 32.5% sodium hydroxide solution, 20 g of an aqueous sodium nitrite solution (1:2), 200 g of an aqueous 10% sodium alginate solution combined with 200 g of an aqueous 10% starch ether solution, and 10 g of water or a thickening mixture as above, to give 1000 g which mixture is then homogenized.

With this printing paste, a mixed fabric of 67% of polyester fibers and 33% of viscose staple fiber is printed by way of machine printing and dried in a mansarde.

By means of a slop-padding device arranged immediately before an Arioli steamer, the printed fabric is then slop-padded with a bath of 20° C. containing 60 $cm^3/l$ of 85% formic acid and is immediately introduced into the steamer. Pressure steam is allowed to act for 5 minutes at 180° C., in which process the coupling, which already started during slop-padding with acid, is completed. Under these conditions part of the azo pigment and above all the disperse dyestuff penetrate by way of diffusion into the polyester fiber; only in exceptional cases a supplementary thermosoling process is recommended to intensify the color shade on the polyester fiber (10 seconds at 190° C.).

On both fiber portions a full and bright orange print is obtained.

In the following Table there are given further Examples, the process being carried out in a manner analogous to that of Example 1. The process includes a great number of combinations and is therefore in no way limited to these Examples.

| Ex. | g kg | Azoic Coupling Component | C.I. No. | g kg | Azoic Diazo Component 40% | C.I. No. | g kg | Disperse dyestuffs | C.I. No. red | Color Shade |
|---|---|---|---|---|---|---|---|---|---|---|
| 2 | 50 | 37 530 | 125 | 42 | 37 150 | 12 | | 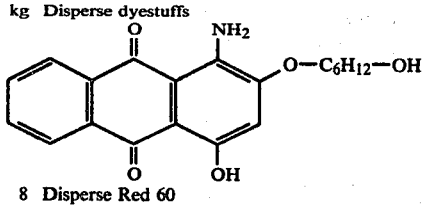 | | |
| | | | | | | | 8 | Disperse Red 60 | 60 756 | |
| | | | | | | | 3 | Disperse Yellow 64 | 47 023 | |
| 3 | 50 | 20 | 37 530 | 125 | 132 | 37 111 | 26 | 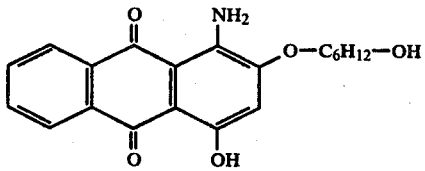 | | scarlet |
| | | | | | | | 20 | Disperse Orange 13 | 26 080 | |
| 4 | 50 | 18 | 37 520 | 62.5 | 14 | 37 151 | 25 | 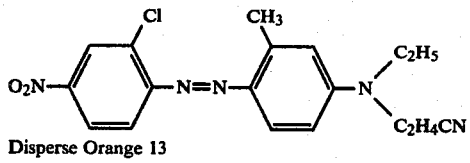 | | red |
| 5 | 50 | 12 | 37 550 | 125 | 42 | 37 150 | 10 | Disperse Orange 13 | 26 080 | |
| | | | | | | | 22 | 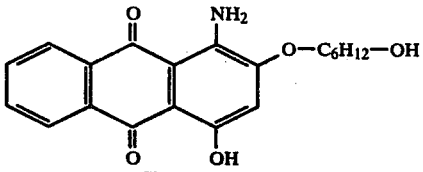 | | red |
| | | | | | | | 15 | 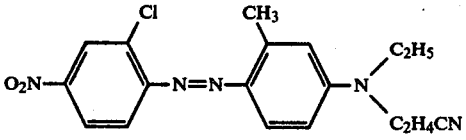 | | |
| 6 | 50 | 5 | 37 610 | 62.5 | 132 | 37 111 | 30 | 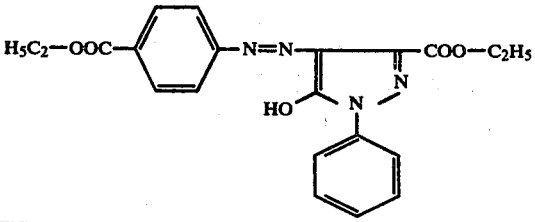 | | yellow |

EXAMPLE 7

The process is carried out according to the method described in Example 1, however, while using the coupling component Azoic Coupling Component 20 with the C.I. No. 37 530 and the diazo component Azoic Diazo Component 132 with the C.I. No. 37 111 in the form of a 40% very fine dispersion, but without any further addition of disperse dyestuffs.

Under the same process conditions there is obtained a full bright print (scarlet) on the mixed fabric. Both fiber portions are practically covered to the same depth.

What is claimed is:

1. A process for the printing of textile mixed fabrics of polyester and cellulose fibers, which comprises printing on the fabric a printing paste containing coupling components dissolved in an alkaline medium, sodium nitrite and diazotizable primary aromatic amines as a solution or in the form of an aqueous fine dispersion with a particle size of less than 0.03 mm and which are practically non-volatile at drying temperatures and show a minimum basicity with a pKa of at least 2.2, drying the fabric, treating the printed fabric at room temperature with an aqueous developing bath containing 10 to 100 g/l of 85% formic acid to develope the azo dyestuffs by diazotizing the amines and coupling any diazonium compounds formed with the coupling components, and heat-treating the fabric to complete the coupling and fixation of azo dyestuffs formed simultaneously on the polyester fiber portion with high temperature steam for 3 to 10 minutes at a temperature in the range of 170° to 190° C.

2. The process of claim 1, wherein the printing paste additionally contains dispersion dyestuffs.

3. The process of claims 1 or 2, wherein the fabric undergoes an air passage prior to the heat-treating step.

4. The process of claims 1 or 2, wherein the diazotizable primary aromatic amines are selected from the group consisting of an azoic diazo component 132, C.I. No. 37,111, azoic diazo component 29, C.I. No. 37,140, azoic diazo component 31, C.I. No. 37,145, azoic diazo component 42, C.I. No. 37,150, azoic diazo component 14, C.I. No. 37,151, azoic diazo component 24, C.I. No. 37,155, azoic diazo component 43, C.I. No. 37,160, azoic diazo component 41, C.I. No. 37,165, azoic diazo component 40, C.I. No. 37,170, azoic diazo component 20, C.I. No. 37,175, azoic diazo component 15, C.I. No. 37,180, azoic diazo component 4, C.I. No. 37,210, azoic diazo component 27, C.I. No. 37,215, and azoic diazo component 48, C.I. No. 37,235.

5. A process for the printing of textile mixed fabrics of polyester and cellulose fibers, which comprises printing on the fabric a printing paste containing coupling components dissolved in an alkaline medium, sodium nitrite and diazotizable primary aromatic amines as a solution or in the form of an aqueous fine dispersion with a particle size of less than 0.03 mm and which are practically non-volatile at drying temperatures and show a minimum basicity with a pka of at least 2.2, drying the fabric, treating the printed fabric at room temperature with an aqueous developing bath containing 10 to 100 g/l of 85% formic acid to develope the azo dyestuffs by diazotizing the amines and coupling any diazonium compounds formed with the coupling components, and heat-treating the fabric to complete the coupling and fixation of azo dyestuffs formed simultaneously on the polyester fiber portion with steam for 3 to 20 seconds at 100° to 130° C. and subjecting the fabric to dry heat for 10 to 40 seconds at 190° to 210° C.

6. The process of claim 5, wherein the fabric is passed through a high temperature steamer for 3 to 10 minutes at 170° to 190° C. after it is steamed for 3 to 20 seconds at 100° to 130° C.

7. The process of claim 5, wherein the printing paste additionally contains dispersion dyestuffs.

8. The process of claims 5 or 7, wherein the fabric undergoes an air passage prior to the heat-treating step.

9. The process of claims 5 or 7, wherein the diazotizable primary aromatic amines are selected from the group consisting of an azoic diazo component 132, C.I. No. 37,111, azoic diazo component 29, C.I. No. 37,140, azoic diazo component 31, C.I. No. 37,145, azoic diazo component 42, C.I. 37,150, azoic diazo component 14, C.I. No. 37,151, azoic diazo component 24, C.I. No. 37,155, azoic diazo component 43, C.I. No. 37,160, azoic diazo component 41, C.I. No. 37,165, azoic diazo component 40, C.I. No. 37,170, azoic diazo component 20, C.I. No. 37,175, azoic diazo component 15, C.I. No. 37,180, azoic diazo component 4, C.I. No. 37,210, azoic diazo component 27, C.I. No. 37,215, and azoic diazo component 48, C.I. No. 37,235.

* * * * *